United States Patent [19]

Kimura et al.

[11] 4,438,907

[45] Mar. 27, 1984

[54] GAS BLOWING NOZZLE, AND PRODUCTION AND USAGE THEREOF

[75] Inventors: Narito Kimura, Yokohama; Kiyomi Taguchi, Fukuyama; Masayuki Hammyo, Fukuyama; Osamu Terada, Fukuyama; Teruyuki Hasegawa, Fukuyama; Youichi Nimura, Fukuyama; Noriyuki Hiraga, Fukuyama, all of Japan

[73] Assignee: Nippon Kokan Kabushiki Kaisha, Tokyo, Japan

[21] Appl. No.: 384,346

[22] Filed: Jun. 2, 1982

[30] Foreign Application Priority Data

| | | | |
|---|---|---|---|
| Jun. 3, 1981 | [JP] | Japan | 56-84321 |
| Aug. 27, 1981 | [JP] | Japan | 56-125950[U] |
| Aug. 27, 1981 | [JP] | Japan | 56-133287 |

[51] Int. Cl.[3] ..... C21B 7/16

[52] U.S. Cl. ..... 266/217; 266/224; 266/265; 266/270; 239/556; 239/DIG. 19

[58] Field of Search ..... 266/265, 266, 267, 268, 266/224, 225, 217, 270; 75/51, 52, 59, 60; 420/563; 239/591, 556, 548, DIG. 19; 264/271.1, 259, 275, 279.1

[56] References Cited

U.S. PATENT DOCUMENTS

| | | | |
|---|---|---|---|
| 1,390,694 | 9/1921 | Frawley, Jr. | 266/224 |
| 3,817,744 | 6/1974 | LeRoy et al. | 266/268 |
| 4,317,679 | 3/1982 | Dantzig et al. | 266/217 |

FOREIGN PATENT DOCUMENTS

| | | | |
|---|---|---|---|
| 905863 | 9/1962 | United Kingdom | 266/224 |

*Primary Examiner*—M. J. Andrews
*Assistant Examiner*—Robert L. McDowell
*Attorney, Agent, or Firm*—Moonray Kojima

[57] ABSTRACT

A gas blowing nozzle is produced by molding a non-porous substance into a molding frame under pressure and at the same time positioning a plurality of gas passageways forming members at predetermined spaces and distances from each other. The passageway holes have cross sectional shapes as desired, so that the gas blowing may be accurately controlled to perform refining of molten metal.

4 Claims, 13 Drawing Figures

GAS BLOWING NOZZLE, AND PRODUCTION AND USAGE THEREOF

BACKGROUND OF THE INVENTION

1. Field of the Invention

This invention relates to gas nozzles, and more particularly to such nozzles as useful in refining molten metals, and to a method of manufacturing such nozzles and the use of such nozzles.

2. Description of the Prior Art

Molten metal may be refined by blowing gas through nozzles disposed at the bottom of a converter. This practice is carried out in bottom blowing converters, top-bottom blowing converters, or the A.O.D. process (Argon Oxygen Decarburization).

The nozzle, which is disposed at the bottom or at a wall of such converters, usually comprises a refractory structure which is positioned at the bottom of the converter, a plurality of passages made in the refractory structure, a gas storage area formed at the lower part of the refractory structure for keeping constant the amount of gas flowing into the passages, and a gas pipe for supplying gas to the nozzle. The gas is blown through a gas pipe connected to a gas source into the converter via the gas storage area and through each of the passages.

When blowing gas into the converter via the nozzle of the mentioned prior art structure, the gas directly attacks the refractory structure, depending upon the relation therebetween, and causes deterioration of the refractory structure, (for example using a refractory material of MgO.C brick and $CO_2$ gas), and thus resulting in shortening of the life of the refractory structure. When the refractory structure is caused to become thin due to deterioration or losses due to action of the molten metal, and if the refractory structure is directly affected at its bottom, the nozzle may become broken by the pressure of the gas. Thus, since the life of the nozzle is extremely short, and the above problems exist, the range of gas pressure to be used cannot be made large.

In the prior art, one or more of the following methods have been used in producing gas nozzles having refractory structures which can be positioned at the bottom of a vessel supporting molten metal.

(1) The grain sizes of raw materials of the refractory structure may be controlled so that a porous refractory structure is produced by the forming and baking process.

(2) A burnable material may be used, together with the refractory raw material effected with grain size control, wherein the burnable material and refractory material are mixed, formed and the burnable material subsequently burned to produce a porous refractory structure.

(3) A plurality of narrow, lengthy pieces of paper or wood may be buried in a body of refractory structure, and subsequently removed to form holes running in straight lines from the exposed working face contacting the molten metal to the read end. For an example of such method, see Japanese Laid Open Patent Specification No. 42,531/72.

The above mentioned conventional manufacturing methods all have deficiencies and problems. For example, in the above mentioned methods (1) and (2), it is difficult to make gas flow in one direction; instead, the flowing directions are at random. Thus, it is necessary to seal the side face of the nozzle, other than the gas jetting face and the gas supplying face, with non-porous refractory material or sealing material. The conventional methods make the refractory structure porous by controlling the grain sizes. Thus, the amount of jetting gas is restricted. A large amount of air permeability cannot be obtained. Furthermore, since the sizes and shapes of the holes for passage of gas are varied, the gas jetting pressure is not constant. Thus, losses or damage caused by molten metal is large. Moreover, because the entire refractory structure is porous, long life cannot be obtained.

The gas blowing refractory structure made by the above method (3) seemingly has solved the above problems, but in actuality, other problems and deficiencies have been found to exist. For example, Paper or wood is generally low in strength and is deformed during processing. Thus, using this prior technique, it is difficult to provide accurate predetermined diameters of the holes used for passing gas, and cracks are caused to be formed in the refractory body when high pressure is effected during gas passage.

Furthermore, the burning material generates unwanted volatile matter or gas. Cracks are created during burning and burnable leftovers often remain in the refractory structure. Perfect opening of gas passageways cannot be obtained. It is especially difficult to produce nozzles of required sizes (e.g. large lengths) to be used at the bottom of the converter.

Moreover, temperatures of operation should be higher than the burning temperature to form narrow holes. Also, the above methods cannot be applied to non-burnt refractory structures, or non-burnt castable cast products.

Due to these problems, and deficiencies, refractory structures of the prior art are limited with constant holes being formed in only limited areas, with jetting of large volumes of gas.

Furthermore, as top blow converters have become large scaled, gas is blown from the bottom of the converter to circulate molten metal. This practice is called top-bottom blowing. For such bottom blowing nozzles, SUS pipes or porous bricks are employed.

With respect to the nozzle of the pipe, the diameter is generally from 5 to 20 mm, and the flow rate of gas should be higher than mach, and if the flow rate is lower than mach, the nozzle may tend to become clogged. This is a necessary condition while the converter supports the molten metal. The upper limit is a flow rate which produces a pressure of around 30 kg/cm$^2$, in view of the pressures which can be used industrially. Thus, the range between the two forms what might be termed the control range for the bottom gas flowing. That is to say, the lower limit of flow rate of bottom blowing gas is determined by the flow rate at which there occurs nozzle clogging and the upper limit depends upon the pressure limit of the facility. The range between the lower limit and the upper limit of gas blowing rate is around 2 to 3 times, that is, the upper limit is 2 to 3 multiples of the flow rate at which clogging occurs.

In view of the metallurgical phase, when the bottom gas flow rate is increased, reaction of slag and metal is made active and dephosphorization is accelerated. In low carbon material (C=less than 0.04%), P content is lowered as the amount of gas increases. However, in high carbon materials (C=more than 0.4%), agitation between the slag and metal is too strong and oxidation potential in the steel and the slag is lowered, to extremely deteriorate dephosphorization. Thus, it is seen that the bottom gas flow rate requires 0.005 to 0.011 $Nm^3/min \cdot T$, for providing preferable dephosphorization in the refinging range of C=0.04 to 0.4%. See for example, FIG. 7, which depicts such relationship.

However, in pipe nozzles, since the gas controlling range of flow rate is narrow, the effect is not preferable in the high carbon range with respect to the bottom gas flow rate. When obtaining maximum effect in the low carbon range, the effect in the high carbon range is inferior with the above relevant bottom gas flow rates. When obtaining maximum effect in the high carbon range, the effect in the low carbon range is similarly inferior using the above relevant gas flow rates. Thus, when selecting the gas flow rate (e.g. 0.10 $Nm^3/min \cdot T$) the lower limit of gas flow rate is about 0.03 to 0.05 $Nm^3/min \cdot T$, and dephosphorization is accelerated by lowering C at the end point to low C. Consequently, the yield of molten steel is inevitably lowered and the basic unit of alloy is heightened, and further, since the gas should not be stopped, the basic unit of the bottom blow is restricted.

In order to improve the above deficiencies, of prior pipe nozzles, there has been proposed, a porous nozzle of porous brick which controls the gas flow rate from 0. The porous nozzle is formed by controlling grain sizes within a certain range, and making permeability less than about 100 microns. If the gas blow is stopped while the steel is held in the converter, the steel hardly penetrates into the porous nozzle, and some of the above problems are resolved. However, not all problems are solved. Since the gas runs into crystalline grains of the refractory structure in the porous nozzle, resistance is extremely large there and gas pressure should be kept high to control the gas. Such high gas pressure will inevitably cause damage to the refractory structure of the nozzle. Thus, in conventional nozzles, the upper limit of gas pressure was found to be about 30 $Kg/cm^2$. See for example, FIG. 6, wherein the lower limit due to clogging is depicted together with the upper limit due to facility breakdown.

SUMMARY OF THE INVENTION

Accordingly, the present invention aims to remove the above-mentioned and other defects, problems and deficiencies of conventional steel refining nozzles, to increase the operating range of the bottom gas blowing flow rates, and to lengthen the life of such nozzles. For accomplishing these objects, the nozzle, according to the invention, is sealed with a metal on the bottom, sides and each of the penetrating holes, thereby to prevent gas from directly contacting the refractory structure, and the gas storage area is encircled with a metal plate thereby to reduce gas pressure operating on the refractory structure.

Another object of the invention is to provide a novel method of producing refractory nozzles, especially a novel method of forming the penetrating holes therein. It is preferable that the penetrating holes be 0.1 to 5 mm in diameter, in view of bubbling effects in the molten metal. The cross sectional shape of the hole is optional, and may be such shapes as a circle, an ellipse, a polygon, or others. The hole may be provided therein with a tubular structure and be of refractory material or metal.

A further object of the invention is the use of the novel refractory structure and nozzle, made of non-porous permeable substance and having penetrating holes of from 0.1 to 5 mm in diameter, under operating conditions of blowing gas at a flow rate of from 0 to 0.5 $Nm^3/min \cdot T$, while keeping the pressure of the circulating gas and/or the refining gas above the molten steel+slag static pressure. By using the novel nozzle and carrying out refining under specific conditions, it is possible to enlarge the control range of the bottom gas flow rate, and simplify gas control and increase the life of the nozzle.

DETAILED DESCRIPTION OF PREFERRED EMBODIMENTS

Figure 1:
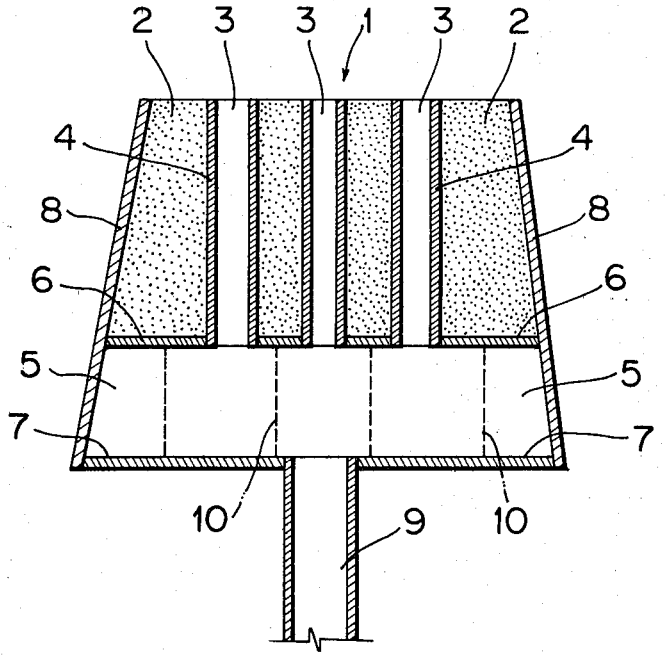
FIG. 1 is a cross sectional view depicting an illustrative embodiment of the invention.

FIG. 1 shows a cross sectional view of an illustrative embodiment of a refractory nozzle 1, wherein the figure is simplified for sake of clarity. The nozzle 1 comprises a refractory structure 2, a plurality of penetrating passages 3 formed in the refractory structure with pipes 4, an upper metal plate 6 and a lower metal plate 7 forming together a gas storage area 5, a metal cover 8 encircling the sides of the refractory structure 2 and the sides of the storage area 5, and a gas pipe 9 positioned at lower metal plate 7, as depicted.

The refractory structure 2 is made of non-porous material and is disposed at the bottom and at the wall of a converter, for example.

The penetrating passages or holes 3 are made by inserting metal pipes 4 into holes running from the working face (toward the top in the figure) which contacts molten metal during the blowing process, to the rear face (toward the bottom in the figure). In the example, the metal pipes 4 are preferably from 0.1 to 5 mm in diameter.

Metal plate 6 is close to the lower surface of refractory structure 2 and forms with a lower metal plate 7 gas storage area 5. Upper metal plate 6 defines holes at portions corresponding to the lower openings of penetrating holes 3. Upper metal plate 6 and metal pipes 4 of holes 3, are integrally connected, such as by welding or screws, and gas storage area 5 communicates with penetrating passages 3, as depicted.

Metal cover 8 contacts upper metal plate 6 and lower metal plate 7 at their circumferences, and encircles refractory structure 2 and gas storage area 5 at their sides. Metal cover 8 is an iron plate, in this embodiment.

Gas pipe 9 interconnects to a gas source (not shown) through metal plate 7 to storage area 5.

In addition to the above mentioned structure, the present invention may provide reinforcing ribs 10 (as shown with dotted lines) between upper metal plate 6 and lower metal plate 7, in order to strengthen the entire structure of nozzle 1 against gas pressure and to reduce the load of the gas pressure on the refractory structure 2. Rib 10 may comprise metal pipes.

A further reference will be made to chemical composition of the refractory nozzle. The refractory structure 2 of nozzle 1 of the invention, may comprise 5 to 30% by weight of carbon, and the remainder being one or more of MgO, $Al_2O_3$, CaO, $Cr_2O_3$ and $ZrO_3$. Having less than 5% carbon increases penetration of slag, to thereby cause large losses by molten metal and damage by thermal spalling. On the other hand, having a carbon content of more than 30% produces inferior strength in the refractory structure, and inferior corrosion resistance. Addition of one or more of the other compounds improves quality, spalling resistance, abrasion resistance and/or strength.

The raw materials used to produce the refractory structure of the invention are oxides, such as MgO, CaO, MgO.CaO, $ZrO_2$, $Al_2O_3$, $Cr_2O_3$ and $AgO.Al_2O_3$; carbon and carbides, such as C, SiC, ZrC, WC, MoC and $B_4C$; and nitrides, such as $Si_3N_4$ and BN.

The present invention aims at providing nonflammable products and baked products mainly composed of the above mentioned components and impregnated with pitch after baking.

The nozzle refractory structure of this invention advantageously very slowly causes loss of speed, such as 0.8 to 0.9 mm/charge, when the penetrating hole is around 1 mm in diameter. Thus, the life of the nozzle is extended.

The process of producing the inventive nozzle will now be discussed. Members, which are used to form straight penetrating passages of 0.1 to 5 mm in diameter, are positioned within a moulding frame. Then, non-porous refractory material, such as those above discussed, is filled into the moulding frame. The passageways forming member may be withdrawn or left in the non-porous material.

For moulding under pressure, it is preferable to repeatedly supply kneaded refractory material at bit at a time, and positioning the hole producing members, at predetermined spaces, and further charging kneaded refractory material. For other processes, the members may be held at both sides and moved as the kneaded refractory materials are moved at an undertaking pressure. The thusly produced body of the nozzle is baked or not baked in accordance with the kind of raw material used. Consequently, the desired product is produced.

It is also preferable that the diameters of the outside passageways be made smaller than those of the inside passageways. This will remove certain disadvantages involved in a conventional process wherein molten metal cover along the working face of the passageways is mushroom in shape, and is unstable and the loss by molten metal is large, so that the gas blowing direction can not be determined, and the gas controlling range is narrow and clogging of the passageways results.

In order to undertake the foregoing operation smoothly, the invention further specifies conditions of determining the spaces between the passageways to be from 3 to 150 mm, the thickness of the pipes to be from 0.1 to 10 mm, the thickness of the cover layer to be from 0.1 to 5 mm, and the distance between the upper metal plate and the lower metal plate of the gas storage area to be from 2 to 50 mm.

Since the nozzle 1 produced by the invention is provided with gas storage area 5, the gas amount is kept constant.

Figure 5:
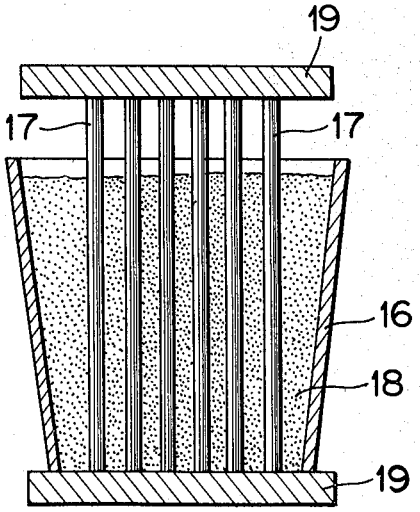
FIG. 5 is a cross sectional view depicting an illustrative moulding process.

When moulding material is used, such as a castable refractory material instead of kneaded refractory material, a plurality of metallic narrow lines 17 (See FIG. 5) used for forming the passageways, are positioned with their upper and lower parts fixed with metal plates 19, and moulding material 18 is supplied into moulding frame 16. Subsequently, the frame 16 is vibrated to form a structure of material 18 with holes produced by pipes 17. The moulding is finished and dried for a certain time, and the lines are withdrawn to form the passages. If pipes are used, those may be left as they are to form the inner wall of the passageways.

Figure 2:
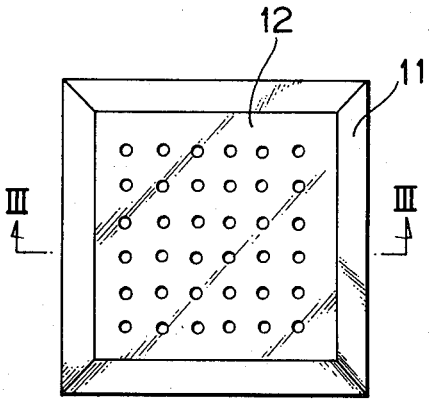
FIG. 2 is a plan view depicting the gas blowing refractory structure of the invention.
Figure 3:
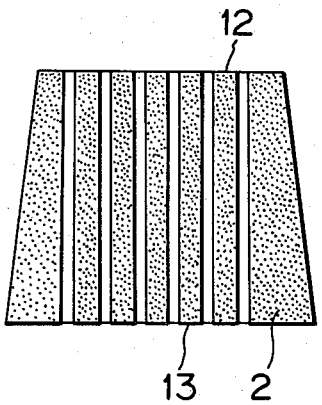
FIG. 3 is a cross sectional view taken along line III—III in FIG. 2.

FIG. 2 shows the working end 12 of an illustrative embodiment. FIG. 3 is a cross sectional view along line III—III in FIG. 2. The figures depict a non-porous refractory structure 11, a work end, which is a working surface, a rear end 13, with refractory structure 2 of refractory material.

Figure 4:
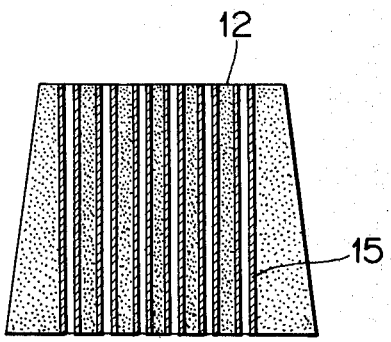
FIG. 4 is a cross sectional view depicting another illustrative embodiment.

FIG. 4 is a cross sectional view of a gas blowing refractory structure of another embodiment wherein metal pipes 15 are used as hole forming members and are left as they are to form the walls of the holes.

The inventive refractory nozzle has many advantages and features and results. For example, it is possible to form a plurality of holes of fixed diameters running in straight lines from the face contacting the molten metal (called work face) to the rear end. Also, advantageously, the present inventive process of producing nozzles may be applied to produce not only baked refractory structures but also to produce non-baked structures. Moreover, it is possible to readily regulate the inner diameter and required numbers of holes, by controlling the diameters of the metal pipes used in the refractory structure, during forming. Furthermore, pipes which are left in the refractory structure to form the walls of the passageways prevent the refractory structure from becoming corroded due to gas, for example, oxygen, carbon gas, or the like, reacting with the refractory structure, so that the reacting gas may be positively blown into the nozzle without any protective additives being necessary.

Figure 6:
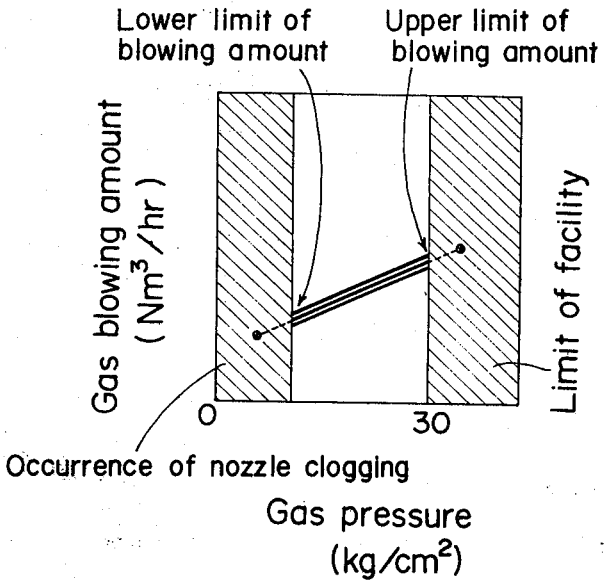
FIG. 6 is a graph depicting the relationship between gas blow rate (called gas blowing amount) and gas pressure and effect on limits.
Figure 7:
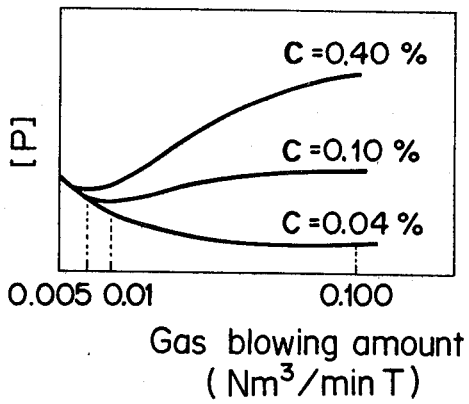
FIG. 7 is a graph depicting the relationship between the amount of Phosphorus and gas flow rate with Carbon as a parameter.

FIG. 6 depicts a graph showing the upper and lower limits of flow rates for gas blowing. When the flow rate is toward the lower limit the nozzle tends to become clogged, and the upper limit is a flow rate for a pressure of about 30 $Kg/cm^2$.

Figure 8:
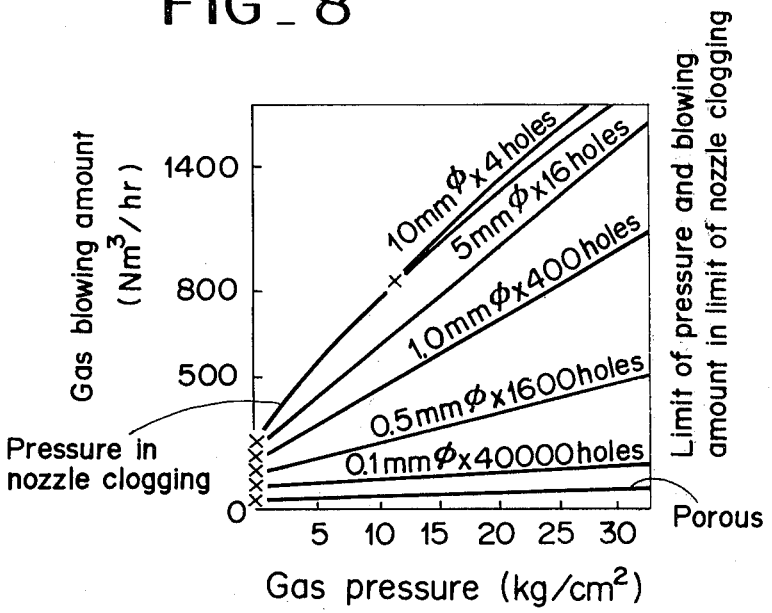
FIG. 8 is a graph depicting the relationship between gas pressure and gas flow rate with hole size and number of holes as parameters.

FIG. 8 depicts the relationship between the gas pressure and flow rate depending on the size of the nozzles and the number of nozzle passageways, for the area between the pressure when clogging occurs and when there is a breakdown due to high pressure. The results show that for previous nozzles, the flow rate is shown, and for larger sized passageways the flow rate increases.

Figure 9:
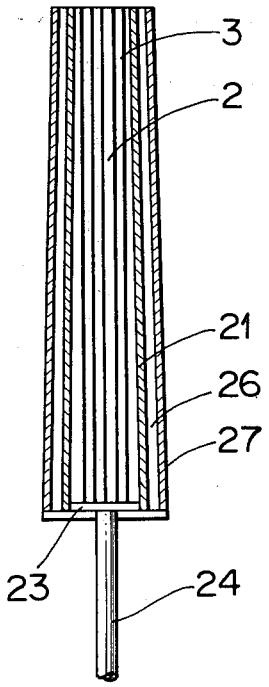
FIG. 9 is a cross sectional view depicting another illustrative embodiment.

FIG. 9 shows another illustrative nozzle which is covered with a sleeve 26 composed of a non-porous refractory material with an iron outside plate 27 and an iron inside plate 21, in order to provide strength as a whole. The nozzle comprises holes 3, refractory material 2, and storage area or holder 23, and pipe 24.

In the invention, the nozzles may be positioned at the bottom and/or at the walls of a converter for carrying out bottom gas blowing and/or at the same time, gas up-blow.

The kinds of bottom blowing gases which may be used are inert gases, such as AR, $N_2$ or the like, hydrocarbon, $CO_2$ or oxygen. With respect to $O_2$, if its composition ratio when mixed one or more other gases, is less than 70% by weight, the gas mixture may be used. If oxygen content of more than 70% is used, the refractory structure will become extremely damaged and the metal pipe may be lost.

The pressure of the bottom blow gas is determined to be above molten metal+slag static pressure. If the pressure is less than molten metal+slag static pressure, the metal or the slag will get into the passageway holes and clog them. The bottom blow gas flow rate is determined to be from 0 to 0.5 $Nm^3/min \cdot T$. If the flow rate is more than 0.5 $Nm^3/min \cdot T$, the basic unit of bottom blow gas is increased, and thus increase cost, and the heat loss is increased due to the cooling effect of molten metal by the bottom blowing. The optimum gas flowing amount may be determined by the content of C and P at the ending point, required to the converter blowing. That is to say, when increasing the flow rate of the bottom gas, the agitation between the slag and molten metal is accelerated and the refining reaction comes nearer to equilibrium. But, oxidation potential is lowered together with the increase of the bottom gas flow rate in the high carbon content range, wherein oxidation potential is low per se, and dephosphorization is made inferior. Thus, the optimum gas flow rate is determined by the P level, and sub-raw materials in the molten metal. It is difficult to measure the oxidation potential in slag.

Figure 10:
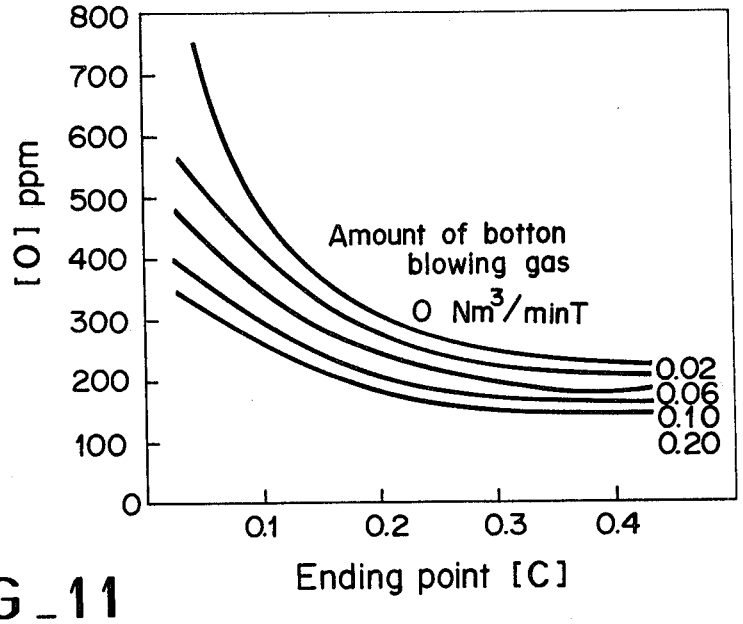
FIG. 10 is a graph depicting the relationship between carbon at ending point and oxygen, with flow rate as a parameter.
Figure 11:
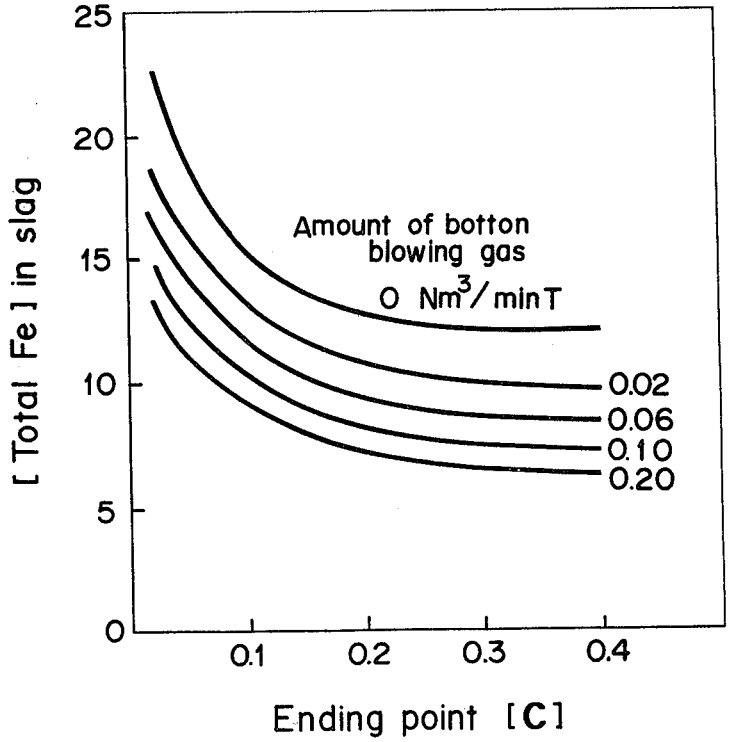
FIG. 11 is a graph depicting the relationship between carbon at ending points and total iron in the slag, with flow rate as a parameter.

FIGS. 10 and 11 show the relationship between oxygen as measured in parts per million in the metal, and the total iron in the slag with carbon in the molten metal, for the different flow rates of the blow gas.

Table 1, hereinbelow, shows a comparison between the process of the invention and a conventional process wherein Ar gas was used for the bottom blow gas in a converter of 180 T capacity.

TABLE 1

| | A | B | C D | C E | F | G |
|---|---|---|---|---|---|---|
| Pipe Nozzle | 10 mmϕ | × 4 | 8 $Kg/cm^2$ | 30 $Kg/cm^2$ | 2.0 mm/Heat | Stainless pipe Sleeve brick . . . |
| | | | 600 $Nm^3/hr$ | 200 $Nm^3/hr$ | | electrofused magnesia |
| Porous nozzle | 150 mmϕ/ | × 4 | 0 $Kg/cm^2$ | 30 $Kg/cm^2$ | 2.1 mm/heat | Electrofused |
| | | | 0 $Nm^3/hr$ | 500 $Nm^3/hr$ | | magnesia |
| Nozzle of | 1 mm | × 4 | 2 $Kg/cm^2$ | 30 $Kg/cm^2$ | 0.8 mm/Heat | Electrofused |
| Invention | (60 holes) | | 0 $Nm^3/hr$ | 2000 $Nm^3/hr$ | | magnesia |

NOTES:
A = size of nozzle;
B = number of nozzles used;
C = gas pressure and flow rate in the gas control range;
D = minimum;
E = maximum;
F = melting speed of the nozzle by molten metal;
G = materials used.

As can be seen from the Table 1, the invention had a larger range of gas pressures and flow rates, and improved durability.

The below Table 2 shows the metallurgical properties of the invention.

TABLE 2

| | A | H | I | J K | J L |
|---|---|---|---|---|---|
| Pipe nozzle | 10 mmϕ | 0.04 | 0.10 | 0.010 | 13.0 |
| | | 0.40 | 0.05 | 0.040 | 6.0 |
| Porous nozzle | 150 mmϕ | 0.04 | 0.07 | 0.013 | 17.0 |
| | | 0.40 | 0.01 | 0.015 | 9.0 |
| Nozzle of the | 1 mmϕ | 0.04 | 0.10 | 0.010 | 13.0 |
| Invention | 60 holes | 0.40 | 0.01 | 0.015 | 9.0 |

NOTES:
A = size of nozzle;
H = stop blowing Carbon %;
I = bottom gas blowing flow rate $Nm^3/min \cdot T$;
J = stop blowing;
K = Phosphorus %;
L = total iron %.

As can be seen from Table 2, depending on the invention, when C is the low carbon steel is 0.04%, the blowing stop phosphorus percentage is low, and the total iron in the slag is low. When the high carbon steel is 0.40%, the bottom blowing gas could be controlled to be low and the blowing stop phosphorous was low.

Figure 12A:
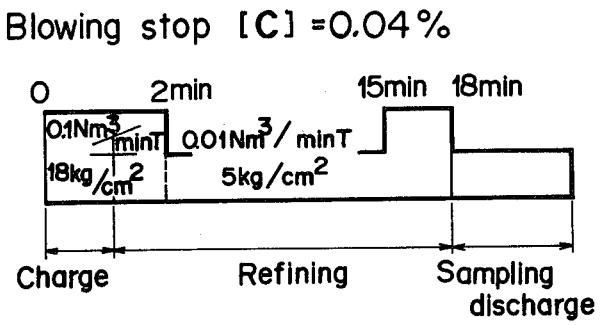
FIGS. 12(A) and 12(B) depict blowing patterns.
Figure 12B:
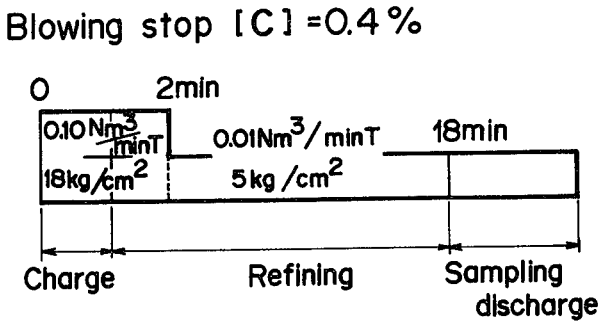

FIG. 12(A) and FIG. 12(B) show the conditions for blowing for Carbon content of 0.04% and for 0.4%, respectively.

During decarburization of low carbon steel, the bath is agitated by CO boiling, so that the amount of bottom blow gas may be saved. Comparing with the basic unit of gas of 1.4 $Nm^3/T$, of a conventional pipe nozzle, the same metallurgical properties may be obtained with 0.8 $Nm^3/T$ using the invention.

It is also possible to reduce the gas flow rate to almost zero while keeping the gas pressure at molten steel+-slag static pressure.

The foregoing description is illustrative of the principles of the invention. Numerous extensions and modifications thereof would be apparent to the worker skilled in the art. All such extensions and modifications are to be considered to be within the spirit and scope of the invention.

What is claimed is:

1. A nozzle for refining molten metal, comprising a non-porous refractory structure positionable at a bottom or a wall of a converter; a plurality of passageways for transmitting gas formed in said refractory structure, said passageways being of metal pipes; an upper metal plate and a lower metal plate defining therebetween a gas storage area communicating with said passageways at the bottom of said refractory structure, said upper plate having a plurality of holes corresponding to said passageways; a metal cover encircling said refractory structure and said storage area; and lead pipe connectable to said lower metal plate, said metal pipes being connected to said holes in said upper metal plate; wherein said passageways have a a diameter of from 0.1 to 5 mm, and have a space therebetween of from 3 mm to 150 mm; wherein said plurality of passageways have walls of metal with thicknesses of from 0.1 to 10 mm; wherein said metal cover has a thickness of from 0.1 to 5 mm; wherein said gas storage area has a space between said upper metal plate and said lower metal plate of from 2 mm to 50 mm distance; and wherein said said plurality of passageways comprises a plurality of outside passageways and a plurality of inside passageways, said outside passageways being disposed on the outside of said inside passageways, said outside passageways having a diameter smaller than the diameter of said inside passageways.

2. The nozzle of claim 1, wherein said passageways have a cross sectional shape of a circle, an ellipse or a polygon.

3. The nozzle of claim 1, wherein said passageways are tubular and have walls comprising the same material as said refractory structure.

4. The nozzle of claim 1, wherein each of said passageways comprises a material different from the material of said refractory structure.

* * * * *